US008337085B2

(12) United States Patent
Nagaraj et al.

(10) Patent No.: US 8,337,085 B2
(45) Date of Patent: Dec. 25, 2012

(54) AIR CIRCULATION PORTS IN ROTARY ROCK BIT JOURNAL BEARING

(75) Inventors: Mahavir Nagaraj, Spring, TX (US); Jeremy Marcus, The Woodlands, TX (US); Vincent Wayne Shotton, Broken Arrow, OK (US); Sameer Bhoite, Conroe, TX (US)

(73) Assignee: Sandvik Intellectual Property AB, Sandviken (SE)

( * ) Notice: Subject to any disclaimer, the term of this patent is extended or adjusted under 35 U.S.C. 154(b) by 486 days.

(21) Appl. No.: 12/436,710

(22) Filed: May 6, 2009

(65) Prior Publication Data

US 2010/0284636 A1 Nov. 11, 2010

(51) Int. Cl.
*F16C 33/00* (2006.01)
*F16C 31/00* (2006.01)
*E21B 10/00* (2006.01)

(52) U.S. Cl. ..... 384/95; 384/92; 175/371

(58) Field of Classification Search ..... 384/92, 384/93, 95, 121, 123, 126, 127; 175/337, 175/417, 359, 371, 372
See application file for complete search history.

(56) References Cited

U.S. PATENT DOCUMENTS 4,108,692 A * 8/1978 Quinlan ..... 148/534
4,136,748 A * 1/1979 Dickerhoff ..... 175/337
4,194,794 A 3/1980 Kling
4,272,134 A 6/1981 Levefelt
4,421,184 A 12/1983 Mullins
4,549,820 A * 10/1985 Mullins ..... 384/95
5,516,213 A * 5/1996 Moriyama et al. ..... 384/292
5,642,942 A 7/1997 Wagoner
5,868,502 A 2/1999 Cariveau et al.
6,250,407 B1 * 6/2001 Karlsson ..... 175/371

OTHER PUBLICATIONS

Notification of Transmittal of the International Search Report and Written Opinion issued in related International patent applicaion No. PCT/SE2010/050486; Dated Sep. 5, 2010 (11 pages).

* cited by examiner

*Primary Examiner* — James Pilkington
(74) *Attorney, Agent, or Firm* — Osha Liang LLP

(57) ABSTRACT

A thrust bearing system for a roller cone rock bit includes at least one roller cone disposed on a leg having an air channel therethrough, the thrust bearing system including a primary thrust bearing surface on the leg configured to contact a corresponding primary bearing surface on the roller cone, wherein the primary thrust bearing surface on the leg includes at least one air circulation port in fluid communication with the air channel. The thrust bearing system further includes a secondary thrust bearing surface on the leg configured to contact a corresponding secondary bearing surface on the roller cone, wherein the secondary thrust bearing surface on the leg includes at least two air circulation ports located at specified locations in the secondary bearing surface and in communication with the air channel, and wherein a first circulation port is located in an upper half of the secondary thrust bearing surface and a second circulation port is located in a lower half of the secondary thrust bearing surface.

17 Claims, 5 Drawing Sheets

AIR CIRCULATION PORTS IN ROTARY ROCK BIT JOURNAL BEARING

BACKGROUND

1. Field of the Disclosure

Embodiments disclosed herein relate generally to rock drill bits. More particularly, embodiments disclosed herein relate to improved thrust bearings and methods of providing improved thrust bearings for rock drill bits.

2. Background Art

Drilling into rock formations to enable explosive charges to be placed for excavating ore in open-cut mining operations may be carried out by roller air blast drills. Air at high pressure (typically 40 psi) and volume (750 to 2000 cubic feet a minute (cfm)) may be delivered through a bore in the drill string to a rock drill bit. The air supplied to the rock drill bit, which may, for example, be a blade or roller type bit, exits from orifices or nozzles in the bit, cools the bearings of the bit and conveys the debris created by the drilling away from the drilling workface up the borehole. This debris may travel up the borehole at a typical (bailing) velocity of 5,000 to 7,000 feet per minute depending on the size of the borehole and the drill string.

A rotary type rock bit typically includes a rolling cutter element, referred to as a cone, and a stationary element (with reference to the cone) called a leg. FIG. 1 illustrates a typical roller bearing air cooled rotary rock bit 10. The bit 10 includes a bit body 12, threaded pin end 14 and a cutting end 16. Each leg 13 supports a roller cone 18 that is rotatively retained on a journal bearing (not shown) cantilevered from each of the legs 13. Each of the cones 18, for example, support a plurality of tungsten carbide inserts 19 extending from the surface of the cones. The rock bit further includes a fluid or air passage through pin end 14 that communicates with a plenum chamber (not shown) formed in the bit body 12. Typically, one or more air nozzles 15 direct air from the plenum chamber toward a borehole bottom.

FIGS. 2A and 2B show a cross-sectional view and a top view, respectively, of a conventional journal bearing 100 on a leg 13 of the rock bit 10 (without the cone 18). The leg 13 includes a stationary journal bearing 100 that has several machined air passages 104 therein to provide air circulation through the rock bit and to the bearing surfaces. The journal bearing 100 includes axial (thrust) load bearing surfaces 110 and 120 and two radial load bearing surfaces 130 and 131 in which roller bearings (not shown) may be disposed. A plurality of roller bearings may be disposed in roller bearing races 130 and 131 to withstand radial forces applied to the leg 13 during drilling. Further, the journal bearing has a ball race 132 in which balls (not shown) may be inserted to retain a roller cone (18 in FIG. 1) on the leg 13.

The axial load bearing surfaces include a primary thrust bearing surface 110 and a secondary thrust bearing surface 120. The primary and secondary bearing surfaces typically have one or more air circulation ports 115, 125 machined into the bearing surface 110, 120 that provide an outlet from the air passages 104 formed in the leg 13. The air passages 104 are in fluid communication with a main air passage 105 formed in the leg, which in turn is in fluid communication with the plenum (not shown) through the bit body 12. The air passages 104 formed in each leg 13 direct air through each journal bearing to cool and clean the bearing retained between the journal and the roller cones retained thereon.

Additionally, a groove or recess 127 may be machined in the secondary thrust bearing surface 120 to allow air flow to circulate. Typically, the recess 127 may encompass about 35% of the total area of the secondary bearing thrust surface 120. In other words, as shown in FIG. 2C, the "shaded" area represents the total area of the secondary bearing thrust surface 120, and thus the recesses 127 take up about 35% of this total area. Further, a groove 117 may be machined in the primary thrust bearing surface 110 around the air circulation port 115 and filled with a weld inlay (usually a silver inlay) to provide for lubricity during operation. Functionally, either of the two thrust bearing surfaces 110, 120 may be designed to act as the primary thrust load bearing surface. In operation, both of the thrust bearing surfaces 110, 120 are in contact with corresponding thrust bearing surfaces of the rolling cutter element (cone) (not shown), which induces frictional heating and wear of the surfaces.

Rock bits are subjected to a variety of forces during the drilling operation including radial, axial and torsional loads. Components in the bearing system are designed to sustain these forces. However, the rock bit can only operate for so long before the wear and load on the bearing due to the applied forces causes sufficient damage to the bit to necessitate changing to a new bit. Therefore, the bearing system may be considered the life-limiting component of the rock bit. In hard rock formations, the thrust bearing surfaces are subjected to severe impact loads and frictional wear. This is attributed to the higher loads that are required to drill hard rock formations. In some applications, the wear and damage of the thrust bearing surfaces causes failure of the bit even if the cutting elements are still intact. In an ideal situation, the cutting elements would wear out completely before the bearing system failed. Therefore, failure of the bearing system may be considered a premature failure of the bit.

Accordingly, there exists a need for an improvement in the thrust bearing capacity to sustain loads applied on the bearing surfaces during drilling operations.

SUMMARY OF THE DISCLOSURE

In one aspect, embodiments disclosed herein relate to a thrust bearing system for a roller cone rock bit including at least one roller cone disposed on a leg having an air channel therethrough, the thrust bearing system including a primary thrust bearing surface on the leg configured to contact a corresponding primary bearing surface on the roller cone, wherein the primary thrust bearing surface on the leg includes at least one air circulation port in fluid communication with the air channel. The thrust bearing system further includes a secondary thrust bearing surface on the leg configured to contact a corresponding secondary bearing surface on the roller cone, wherein the secondary thrust bearing surface on the leg includes at least two air circulation ports located at specified locations in the secondary bearing surface and in communication with the air channel, and wherein a first circulation port is located in an upper half of the secondary thrust bearing surface and a second circulation port is located in a lower half of the secondary thrust bearing surface.

In other aspects, embodiments disclosed herein relate to a method of optimizing the efficiency of a journal bearing for a rock bit, the method including reducing the area of machined recesses at the first and second air circulation port locations in the secondary thrust bearing surface and maximizing a surface area of a primary bearing surface and a secondary bearing surface, locating the air circulation ports in the primary and secondary bearing surfaces away from a highest loaded region of the surfaces, and locating a first air circulation port in an upper half of the secondary thrust bearing surface and locating a second air circulation port in a lower half of the secondary thrust bearing surface.

In other aspects, embodiments disclosed herein relate to a thrust bearing system for a roller cone rock bit including at least one roller cone disposed on a leg having an air channel therethrough, the thrust bearing system including a primary thrust bearing surface on the leg configured to contact a corresponding primary bearing surface on the roller cone, wherein the primary thrust bearing surface on the leg includes at least one air circulation port in fluid communication with the air channel, a secondary thrust bearing surface on the leg configured to contact a corresponding secondary bearing surface on the roller cone at least two air circulation ports located at specified locations in the secondary bearing surface and in communication with the air channel, and machined recesses at the air circulation port locations, wherein the machined recesses are configured to encompass up to about 25% of a total area of the secondary thrust bearing surface.

Other aspects and advantages of the invention will be apparent from the following description and the appended claims.

DETAILED DESCRIPTION

In one aspect, embodiments disclosed herein relate to improved thrust bearings and methods of providing improved thrust bearings in a roller rock bit. In particular, embodiments disclosed herein relate to optimizing locations of air circulation ports in roller rock bit journal bearings and maximizing bearing surface area to improve thrust bearing performance.

Embodiments of the present disclosure seek to improve the thrust bearing capacity by increasing the surface area available to sustain the thrust loads on the bearing surface in conjunction with optimizing locations of the air circulation ports in the thrust bearing surfaces. During the drilling operation, the thrust loading of the journal bearing is non-uniform, i.e., a portion of the thrust bearing is subjected to a higher load than the rest of the bearing surface. This is due the angle of contact between a roller cone attached to a leg of the rock bit and the formation during drilling. Because of the weight on the rock bit and thus on the roller cones, the bottom half of the journal bearing experiences higher loading than the top half of the journal bearing. After analyzing the bearing surfaces of bits that have prematurely failed, Applicants have determined that a bottom portion of the thrust bearing surface (i.e., a lower 180 degrees of the bearing surface) is subject to higher loads than the upper portion of the bearing surface. Based on this analysis, alternate configurations of the air circulation ports have been developed by Applicants, which maximize the load bearing surface area in the higher loaded portion (bottom half) of the thrust bearing.

Figure 3A:
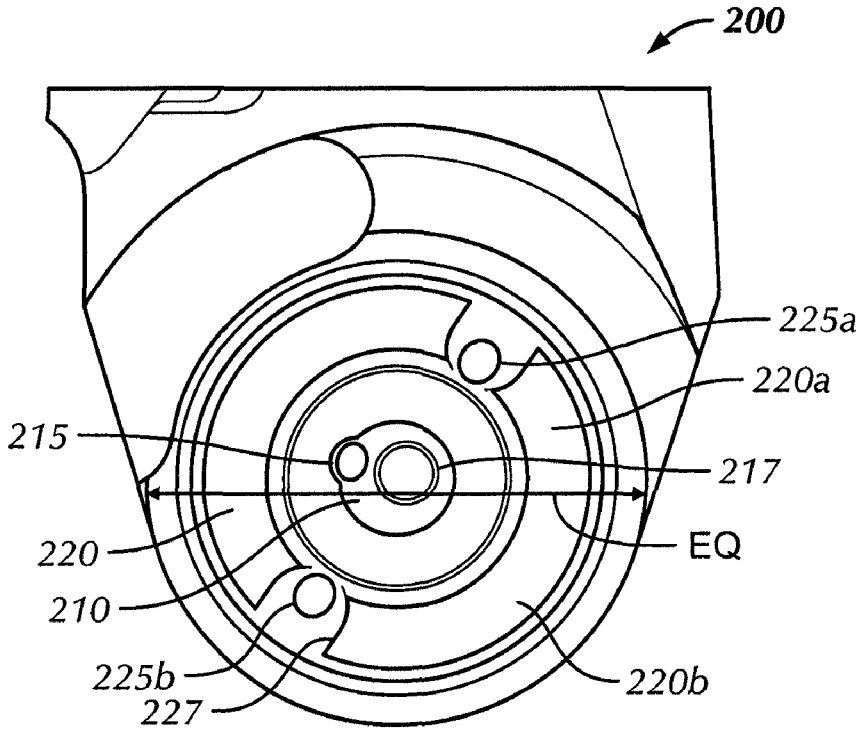
FIG. 3A shows a top view of a journal bearing on the leg of a rock bit in accordance with embodiments of the present disclosure.

FIG. 3A shows a top view of a journal bearing 200 with thrust bearing surfaces 210, 220 configured in accordance with embodiments of the present disclosure. A primary thrust bearing surface 210 includes an air circulation port 215 and a groove 217. The primary thrust bearing surface 210 on the leg may be a tool steel thrust plug or thrust button that is inserted in the end of the journal bearing. Further, a corresponding primary thrust bearing surface on the roller cone (not shown), which contacts the primary thrust bearings surface 210, may include a carbide thrust button. In other instances, the primary thrust bearing 210 on the leg may be a weld inlayed material that is machined to form the bearing surface on the end of the leg. In an alternate embodiment, the primary thrust bearing 210 on the leg may include a carbide thrust button, and the corresponding primary thrust bearing surface on the roller cone may include a tool steel surface.

The secondary thrust bearing surface 220 includes two air circulation ports 225A, 225B with recesses 227 machined into the secondary thrust bearing surface 220 at the air circulation port locations. For discussion purposes later, the secondary thrust bearing surface 220 may be separated into an upper half 220A and a lower half 220B by a central axis EQ. The secondary bearing surface may be weld inlayed with material called "hardmetal," which has higher hardness and is more wear resistant than the base material onto which it is inlayed, to improve wear resistance. For example, the hard metal weld inlay may include, but is not limited to, stellite and carburized steel. In embodiments disclosed herein, the locations of the air circulation port 215 on the primary thrust bearing surface 210 and air circulation ports 225A, 225B on the secondary thrust bearing surface 220, have been designed to maximize the thrust load bearing surface area.

In accordance with embodiments of the present disclosure, the primary thrust bearing surface 210 of the thrust button is configured to withstand axial thrust loads on a roller cone through contact with a hard material surface of the roller cone. The thrust button is configured with a solid surface facing the carbide surface of the roller cone that is devoid of any channels or grooves in the surface. While the primary thrust bearing surface 210 is shown as a solid surface, one of ordinary skill in the art will understand that alternate embodiments may have thrust buttons that include slots (not shown), which extend from a center of the surface to an outer periphery, to improve air circulation. Further, the primary thrust bearing surface 210 of the thrust button includes an air circulation port 215 that is offset from a center of the thrust button. The air circulation port 215 is positioned towards an outer periphery and in an upper half of the thrust button, or away from the higher loaded region of the thrust button.

As described above, the bottom half (i.e., lower 180 degree section) of the bearing experiences the highest axial loading due to the weight on the bit. To increase the efficiency of thrust bearings, more bearing surface area in the highest loaded region may be provided to improve the bearing performance. To achieve this, the bearing surface may be designed to provide a maximum bearing surface area in the highest loaded region (lower 180 degree section). For example, while there is only a maximum amount of surface area available for the primary thrust bearing surface (i.e., the overall surface area cannot be increased without changing the size (e.g., diameter) of the thrust button), the surface area available may be maximized where it is most needed, i.e., at the highest loaded area of the bearing. Therefore, the surface of the primary thrust bearing is designed such that air circulation port 215 is positioned a select distance away from the center of the bearing surface at an outer periphery of an upper section of the bearing surface 210 as shown in FIG. 3A. As such, the maximum amount of surface area available for the bottom half of the primary bearing surface (i.e., all of it) is provided while still having an air circulation port in the surface, which allows for adequate air circulation.

Figure 3B:
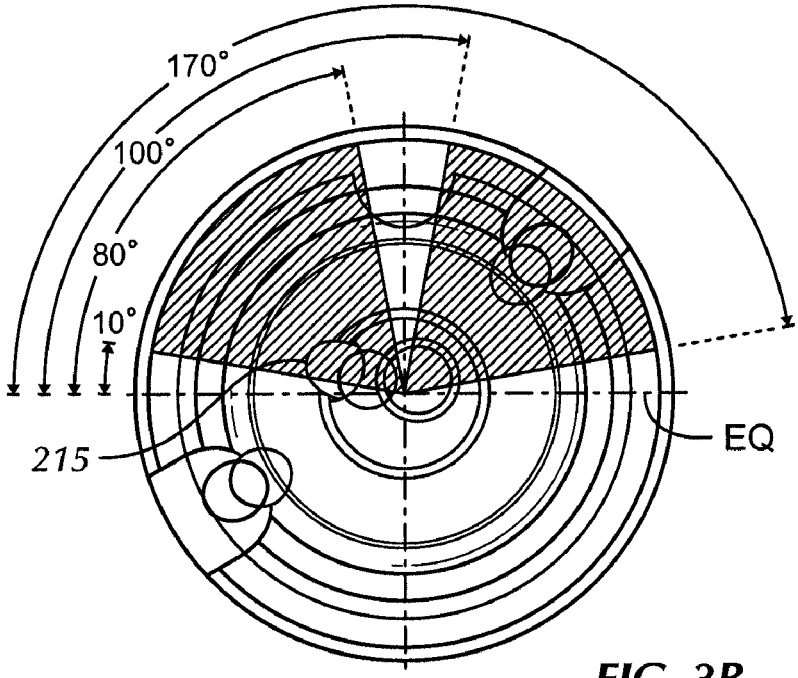
FIG. 3B shows a top view of a journal bearing on the leg of a rock bit showing locations of an air circulation port in a primary bearing surface in accordance with embodiments of the present disclosure.

The air circulation port 215 may be located within a range of angles as shown in FIG. 3B. For example, in reference to horizontal axis EQ, the air circulation port 215 (measured from a center of the air circulation port) may be located within a range of 10 degrees to 80 degrees measured clockwise from axis EQ. Further, the air circulation port 215 may be located within a range of 100 degrees to 170 degrees measured clockwise from axis EQ.

Similarly, the secondary thrust bearing surface is designed in the embodiments disclosed herein to maximize the bearing surface area and increase bearing efficiency. Additionally, due to the larger surface area of the secondary thrust bearing, two driving factors may affect the efficiency of the bearing surface: overall bearing surface area and adequate air circulation over the bearing surface. Embodiments of the present disclosure take both of these factors into consideration to maximize the overall efficiency of the bearing surface.

Each half of the secondary bearing surface 220 may include at least one air circulation port 225A disposed in an upper half of the secondary bearing surface area 220A and thus away from the highest loaded region 220B. Thus, more bearing surface area is available in the bottom half of the bearing surface 220B to withstand the highest axial loads. Because of the larger surface area of the secondary bearing surface 220, more than one air circulation port may be required for air circulation. To provide improved air circulation, tests have shown that the air circulation ports 225A, 225B may be located at specified locations on the bearing surface 220. In certain embodiments, one air circulation port 225A may be located in the upper half 220A of the secondary bearing surface 220 while a second air circulation port 225B may be located in the lower half 220B of the secondary bearing surface 220.

Figure 3C:
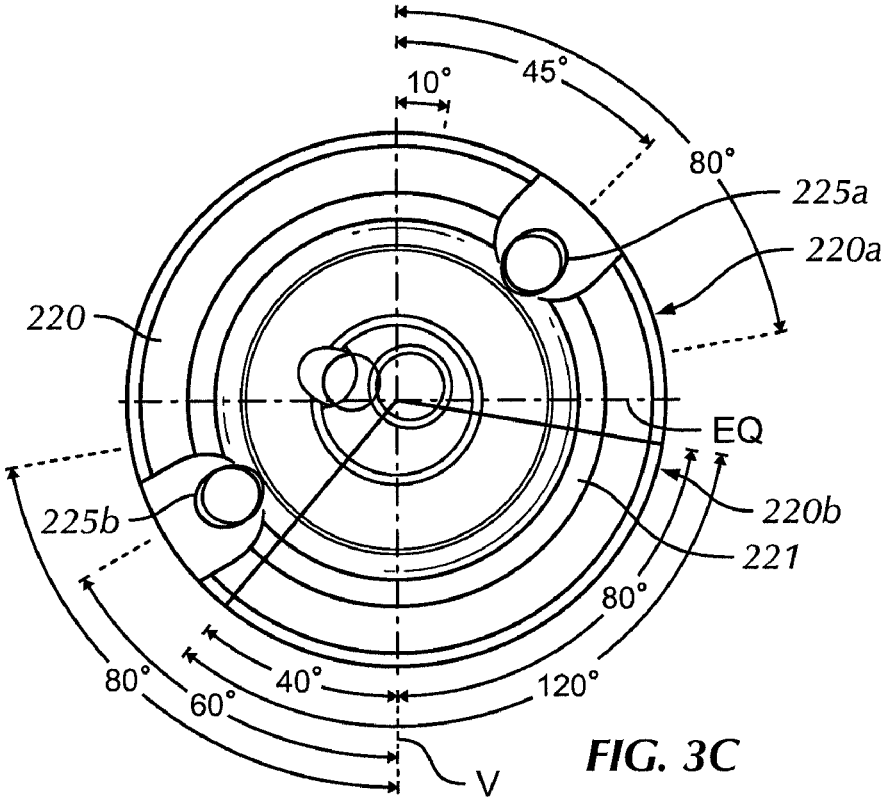
FIG. 3C shows a top view of a journal bearing on the leg of a rock bit with locations of air circulation ports in a secondary bearing surface illustrated in accordance with embodiments of the present disclosure.

Referring now to FIG. 3C, the secondary bearing surface may be divided by central horizontal axis EQ into an upper half 220A and a lower half 220B (as previously described). The bottom half 220B of the secondary bearing surface 220 may be further divided into distinct sections based on the loads experienced in these particular locations of the bearing surface 200. Applicants have identified a high load section 221 that includes approximately 120 degrees (of the available 180 degrees of the bottom half 200B) on which the highest loads are applied during operation. As shown, the high load section 221 includes about 40 degrees measured clockwise from a lower end of a vertical axis V on one side and about 80 degrees measured counterclockwise from the lower end of the vertical axis V on the opposite side.

Therefore, the air circulation port 225B is located outside the high load section 221 so that a maximum bearing surface area is available to withstand the high loads (i.e., 100% of the 120 degree section is devoid of any air port or other feature). As such, the air circulation port 225B located in the lower half 220B of the secondary bearing surface 200 may be positioned within a range of approximately 40 degrees to 80 degrees measured clockwise from the lower end of vertical axis V (measurements taken from the center of the air circulation port to the vertical axis). In certain embodiments, the air circulation port 225B may be positioned at about a 60 degree angle measured clockwise from the lower end of vertical axis V. Thus, the air circulation port 225B may be located outside the high load section 221.

Further, the air circulation port 225A in the upper half 220A of the secondary bearing surface 220 may be located within a range of about 10 degrees to about 80 degrees, when measured clockwise from an upper end of the vertical axis V in the upper half 220A. In certain embodiments, the air circulation port 225A in the upper half 220A of the secondary bearing surface may be located at about 45 degrees from the vertical axis V when measured clockwise from the upper end of the vertical axis V.

Figure 1:
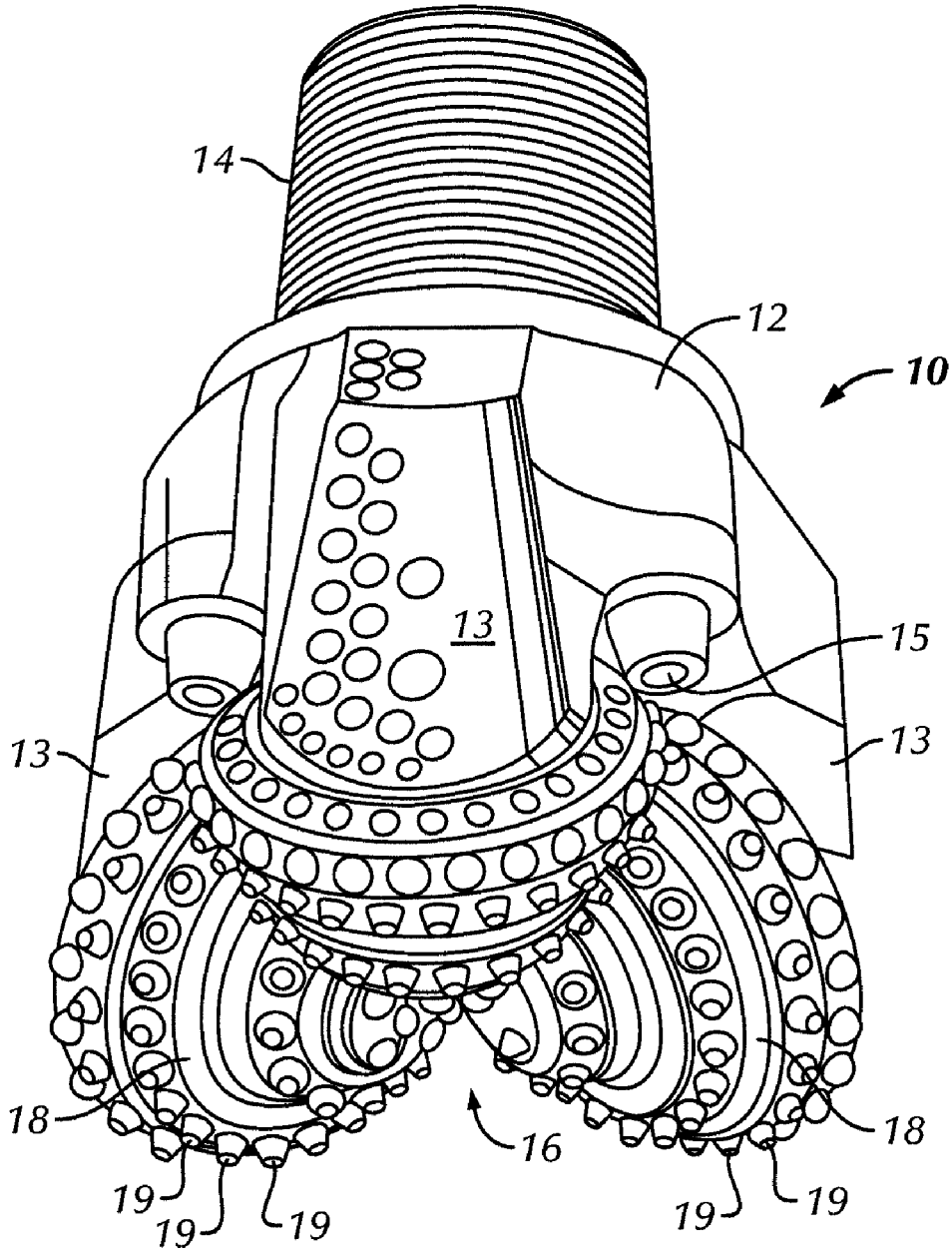
FIG. 1 (Prior Art)
FIG. 1 shows a perspective view of a conventional rock bit.
Figure 2A:
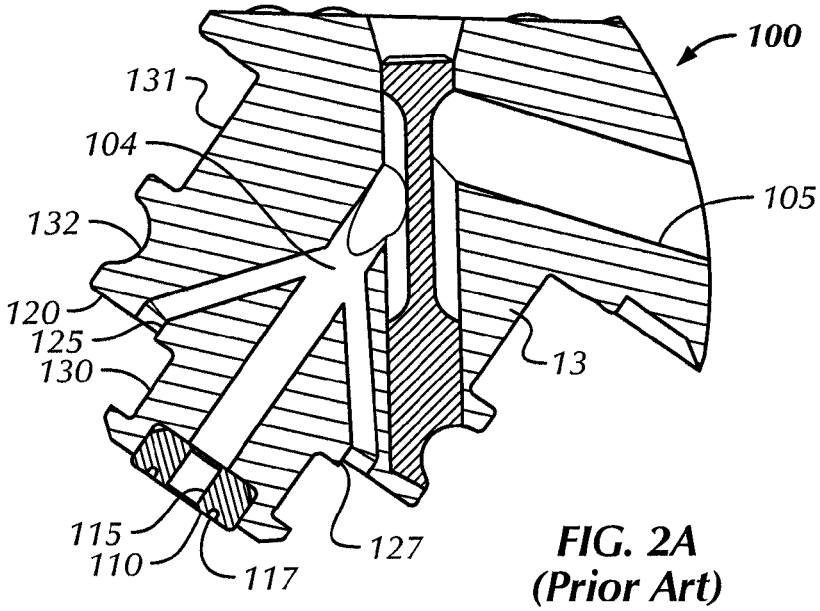
FIG. 2A (Prior Art)
FIG. 2A shows a cross-sectional view of a conventional journal bearing of a rock bit.
Figure 2B:
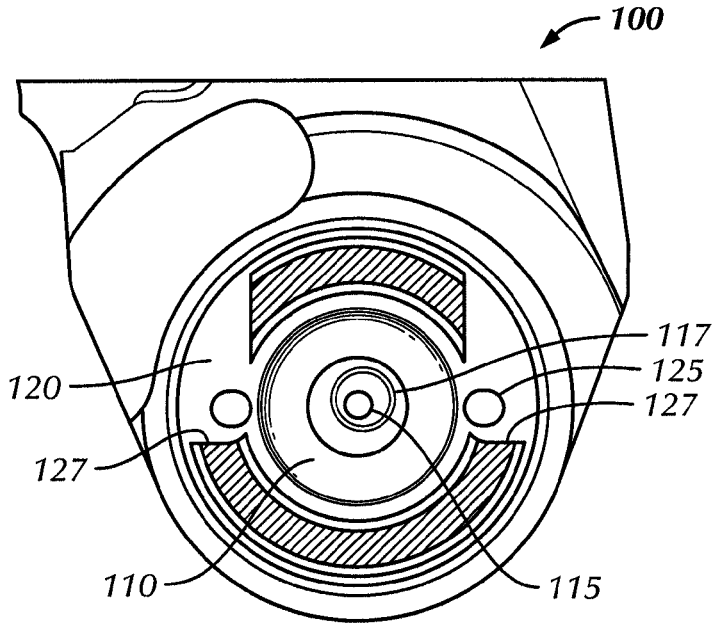
FIG. 2B (Prior Art)
FIG. 2B shows a top view of a conventional journal bearing of a rock bit.
Figure 2C:
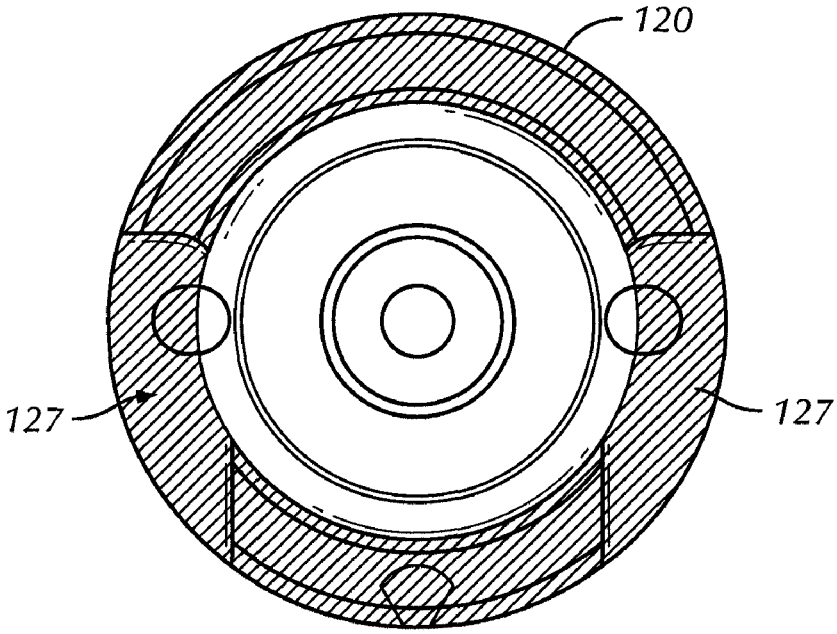
FIG. 2C (Prior Art)
FIG. 2C shows a top view of a conventional journal bearing of a rock bit.
Figure 3D:
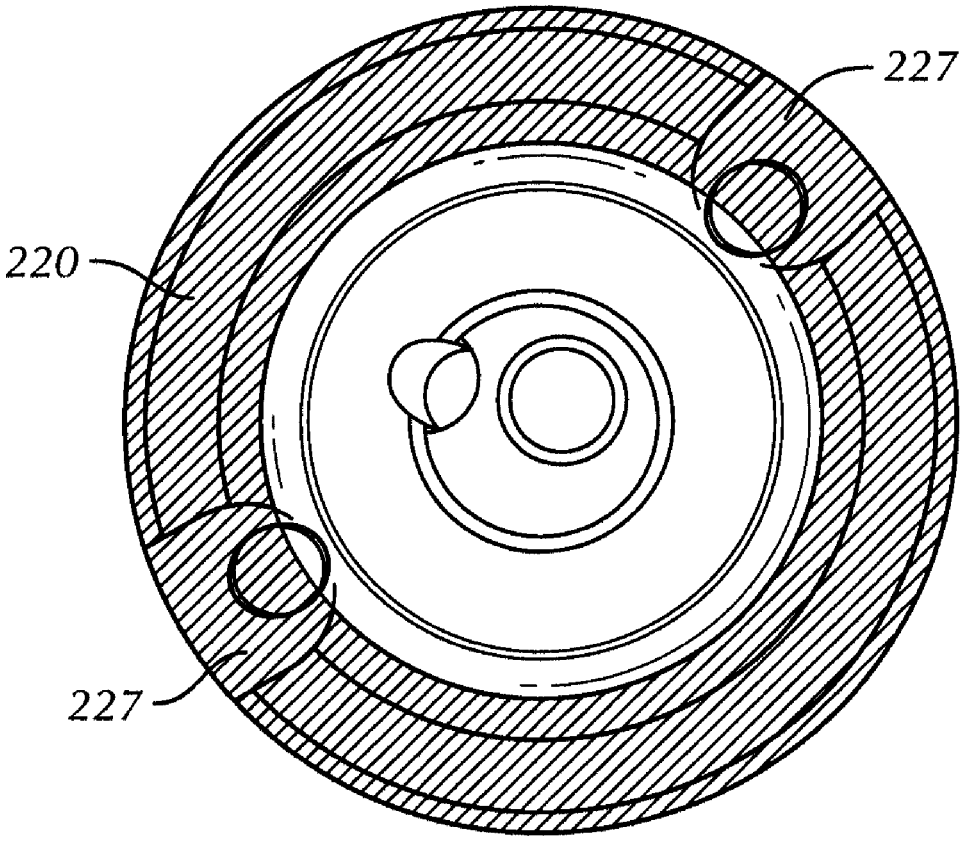
FIG. 3D shows a top view of a journal bearing on the leg of a rock bit in accordance with embodiments of the present disclosure.

Additionally, the machined recesses 227 in the bearing surface are configured to improve bearing efficiency by increasing the bearing surface area. In particular, the area (size) of the recesses 227 is reduced to provide more bearing surface area actually in contact with a surface of the rotating cone (not shown) while still maintaining adequate air circulation. As previously described, the conventional recesses typically cover about 35% of the total bearing surface area for the secondary thrust bearing surface (shown in FIG. 2C). Thus, 65% of the total area of the secondary thrust surface 220 is available to withstand the axial loads. As shown in FIG. 3D, embodiments of the present disclosure reduce the size (area) of the milled recesses to encompass up to about 25% of the total area of the secondary thrust surface 220 (about 75-100% available to withstand axial loads during operation). In certain embodiments, the milled recesses may encompass about 10-18% of the total area of the secondary thrust surface 220. Therefore, about 82-90% of the total area of the secondary thrust surface 220 is available to withstand axial loads during operation.

Testing of rock bits in various worldwide locations (having different formation properties) with different sized journal bearings configured in accordance with embodiments of the present disclosure has shown an increase in both hours and meters drilled. For example, testing in a first location showed an improvement in average hours drilled of almost 15% and an 18% improvement on the average meters drilled. Similarly, in a second testing location, an improvement of 30% in average hours drilled and an improvement of 8% in average meters drilled was shown by using journal bearings described in accordance with embodiments disclosed herein.

Advantageously, embodiments of the present disclosure maximize the load-bearing surface area available on the stationary thrust bearing surface to reduce the contact stresses generated due to the transfer of forces between the rotating cone and the stationary leg. In particular, embodiments disclosed herein eliminate or reduce thrust button breakage and reduce wear on the secondary thrust bearing surface. This leads to a reduction in the wear of the thrust bearing surface on the leg, thereby prolonging the life of operation of the bit. By using journal bearings in accordance with embodiments disclosed herein, cost savings in equipment and rig time may be realized, which may further be conveyed to the customer.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A roller cone rock bit for forming a bore hole, the rock bit comprising:

a bit body having an end for connection to a drillstring;

a plurality of angularly spaced support legs extending from the bit body with each support leg having a journal bearing on an end thereof;

each journal bearing having:

a primary thrust bearing surface;

an air circulation port in the primary thrust bearing surface;

a secondary thrust bearing surface;

a first air circulation port located in an upper 180 degree section of the secondary thrust bearing surface, wherein the first air circulation port in the upper 180 degree section is located within a range of about 10 degrees to about 80 degrees measured clockwise from a vertical axis through a center of the secondary thrust bearing surface and a second air circulation port located in a lower 180 degree section of the secondary thrust bearing surface, wherein the second air circulation port in the lower 180 degree section is located within a range of about 40 degrees to about 80 degrees measured clockwise from the vertical axis through the center of the secondary thrust bearing surface.

2. The thrust bearing system of claim 1, wherein the secondary thrust bearing surface further comprises machined recesses at the air circulation port locations.

3. The thrust bearing system of claim 2, wherein the machined recesses are configured to encompass up to about 25% of a total area of the secondary thrust bearing surface.

4. The thrust bearing system of claim 2, wherein the machined recesses are configured to encompass about 10-18% of a total area of the secondary thrust bearing surface.

5. The thrust bearing system of claim 1, wherein the primary thrust bearing surface on the leg comprises a tool steel and the primary bearing surface of a roller cone in contact with the primary thrust bearing surface of the leg comprises a carbide material.

6. The thrust bearing system of claim 1, wherein the primary thrust bearing surface on the leg comprises a carbide material and the primary bearing surface of a roller cone in contact with the primary thrust bearing surface of the leg comprises a tool steel.

7. The thrust bearing system of claim 1, wherein the secondary thrust bearing surface comprises a hardmetal weld inlay.

8. The thrust bearing system of claim 1, wherein the air circulation port in the primary thrust bearing surface is offset from a center of the primary bearing surface.

9. The thrust bearing system of claim 1, further comprising a solid lubricant groove in the primary thrust bearing surface.

10. The thrust bearing system of claim 1, wherein the second air circulation port in the lower 180 degree section of the secondary thrust bearing surface is located about 60 degrees measured clockwise from the vertical axis through the center of the secondary thrust bearing surface.

11. The thrust bearing system of claim 1, wherein the first air circulation port in the upper 180 degree section of the secondary thrust bearing surface is located about 45 degrees measured clockwise from the vertical axis through the center of the secondary thrust bearing surface.

12. The thrust bearing system of claim 1, wherein the first air circulation port and the second air circulation port in the secondary thrust bearing surface are asymmetric in reference to the vertical axis through the center of the secondary thrust bearing surface.

13. The thrust bearing system of claim 1, wherein the air circulation port in the primary thrust bearing surface is located between about 10 degrees and about 80 degrees measured clockwise from a horizontal axis through a center of the primary thrust bearing surface.

14. The thrust bearing system of claim 1, wherein the air circulation port in the primary thrust bearing surface is located between about 100 degrees and about 170 degrees measured clockwise from a horizontal axis through a center of the primary thrust bearing surface.

15. A thrust bearing system for a roller cone rock bit comprising at least one roller cone disposed on a leg having an air channel therethrough, the thrust bearing system comprising:

a primary thrust bearing surface on the leg configured to contact a corresponding primary bearing surface on the roller cone, wherein the primary thrust bearing surface on the leg includes at least one air circulation port in fluid communication with the air channel;

a secondary thrust bearing surface on the leg configured to contact a corresponding secondary bearing surface on the roller cone;

a first air circulation port located in an upper 180 degree section of the secondary thrust bearing surface, wherein the first air circulation port in the upper 180 degree section is located within a range of about 10 degrees to about 80 degrees measured clockwise from a vertical axis through a center of the secondary thrust bearing surface;

a second air circulation port located in a lower 180 degree section of the secondary thrust bearing surface, wherein the second air circulation port in the lower 180 degree section is located within a range of about 40 degrees to about 80 degrees measured clockwise from the vertical axis through the center of the secondary thrust bearing surface, recesses the first air circulation port and the second air circulation port locations, wherein the recesses are configured to encompass up to about 25% of a total area of the secondary thrust bearing surface.

16. The thrust bearing system of claim 15, wherein the machined recesses are configured to encompass about 10-18% of a total area of the secondary thrust bearing surface.

17. A method of manufacturing a journal bearing on a roller cone rock bit, the method comprising:

providing a roller cone rock bit having:

a bit body having an end for connection to a drillstring;

a plurality of angularly spaced support legs extending from the bit body with each support leg having a journal bearing on an end thereof;

providing a primary thrust bearing surface on the journal bearing configured to contact a corresponding primary bearing surface on the roller cone, the primary thrust bearing surface comprising at least one air circulation port in fluid communication with the air channel;

providing a secondary thrust bearing surface on the journal bearing configured to contact a corresponding secondary bearing surface on the roller cone;

locating a first air circulation port in a first recessed portion of an upper 180 degree section of the secondary thrust bearing surface, wherein the first air circulation port in the upper 180 degree section is located within a range of about 10 degrees to about 80 degrees measured clockwise from a vertical axis through a center of the secondary thrust bearing surface;

locating a second air circulation port in a second recessed portion of a lower 180 degree section of the secondary thrust bearing surface, wherein the second air circulation port in the lower 180 degree section is located within a range of about 40 degrees to about 80 degrees measured clockwise from the vertical axis through the center of the secondary thrust bearing surface; and sizing the first recessed portion and the second recessed portion to encompass up to about 25% of a total area of the secondary thrust bearing surface.

* * * * *